United States Patent [19]

Baarse

[11] Patent Number: 4,604,828

[45] Date of Patent: Aug. 12, 1986

[54] SAFETY DEVICE, IN PARTICULAR FOR AN OVERHEAD DOOR

[75] Inventor: Dick Baarse, Aalsmeer, Netherlands

[73] Assignee: Saturn Limited, Colchester, Great Britain

[21] Appl. No.: 707,909

[22] Filed: Mar. 4, 1985

[30] Foreign Application Priority Data

Mar. 2, 1984 [NL] Netherlands ..... 8400692

[51] Int. Cl.[4] ..... E05D 13/00

[52] U.S. Cl. ..... 49/322; 160/193

[58] Field of Search ..... 49/322; 160/193; 187/83

[56] References Cited

U.S. PATENT DOCUMENTS 1,936,269 11/1933 Schaffert et al. ..... 49/322 X 2,064,470 12/1932 Heckman ..... 49/322 X

*Primary Examiner*—Kenneth Downey

*Attorney, Agent, or Firm*—Edmund M. Jaskiewicz

[57] ABSTRACT

The invention relates to a safety device in particular for an overhead door or the like comprising fastening means for blocking the door which means are operated by an auxiliary cable under tension. The auxiliary cable having a breaking element is on the one hand connected to a reel provided with speed-limiting means for blocking the reel in case the rotation speed becomes beyond certain limits and on the other hand to the door via a lever shaped locking member which cooperates with the fastening means. The fastening means are held in an inoperative position by said locking member, while upon breaking of the breaking element the fastening means are released for blocking the door.

4 Claims, 3 Drawing Figures

SAFETY DEVICE, IN PARTICULAR FOR AN OVERHEAD DOOR

BACKGROUND OF THE INVENTION

The present invention relates to a safety device, in particular for an overhead door, comprising fastening means for blocking the door, which means are operated by an auxiliary cable under tension, which is connected on the one hand to the door and on the other hand to a reel provided with a speed-limiting means, the latter blocking the reel and hence the auxiliary cable when the door exceeds a predetermined rate of descent and the fastening means becomes operative.

A safety device of this kind is known for a lift from French Pat. No. 384,422. In this patent, the auxiliary cable is directly connected to the fastening means, which in this case consists of a wedge-shaped element. If the lift becomes too fast the auxiliary cable blocks and the wedge-shaped element is displaced relative to the lift and consequently in turn blocks the lift.

This construction has the disadvantage that the safety device does not work if the auxiliary cable breaks or when the latter is not tensioned for other reasons.

SUMMARY OF THE INVENTION

The present invention aims at providing a fall safety device for an overhead door or the like, in which the abovementioned disadvantage is avoided in a suitable manner. This aim is achieved according to the invention, in that the auxiliary cable is provided with a breaking element which breaks when the reel is blocked, while the fastening means is under pressure and becomes operative when the tension in the auxiliary cable is removed. By this means the safety device of the overhead door becomes operative automatically when the tension in the auxiliary cable is removed for one reason or another, which provides for additional safety.

It may be noted that the Russian Pat. No. 770,958 discloses a blocking device for a door, in which the blocking device only becomes operative when the operating cable of the door breaks. This construction has the disadvantage on the one hand that a fastening means is at all times loaded by the weight of the door while on the other hand the safety device does not become operative when the rate of descent becomes too great for reasons other than the breaking of the operating cables.

According to the invention, a lever-shaped locking member is fastened rotatably to the door, the lever being connected on the one hand to the auxiliary cable and on the other hand acting upon the fastening means, and the locking member being capable of holding the fastening means under spring pressure in a non-operative position as a result of the tension in the auxiliary cable.

In a preferred embodiment, the fastening means according to the invention is formed by a bar, which is rotatably connected to the door near one outer end and can engage with its other free outer end into an opening in a post attached beside the door, the bar being under pressure from a spring which seeks to press the bar into engagement with the post and being provided with a projecting cam which cooperates with the locking member.

DESCRIPTION OF THE DRAWINGS

The invention will be illustrated with reference to the accompanying drawings, in which.

DESCRIPTION OF THE PREFERRED EMBODIMENTS

Figure 1:
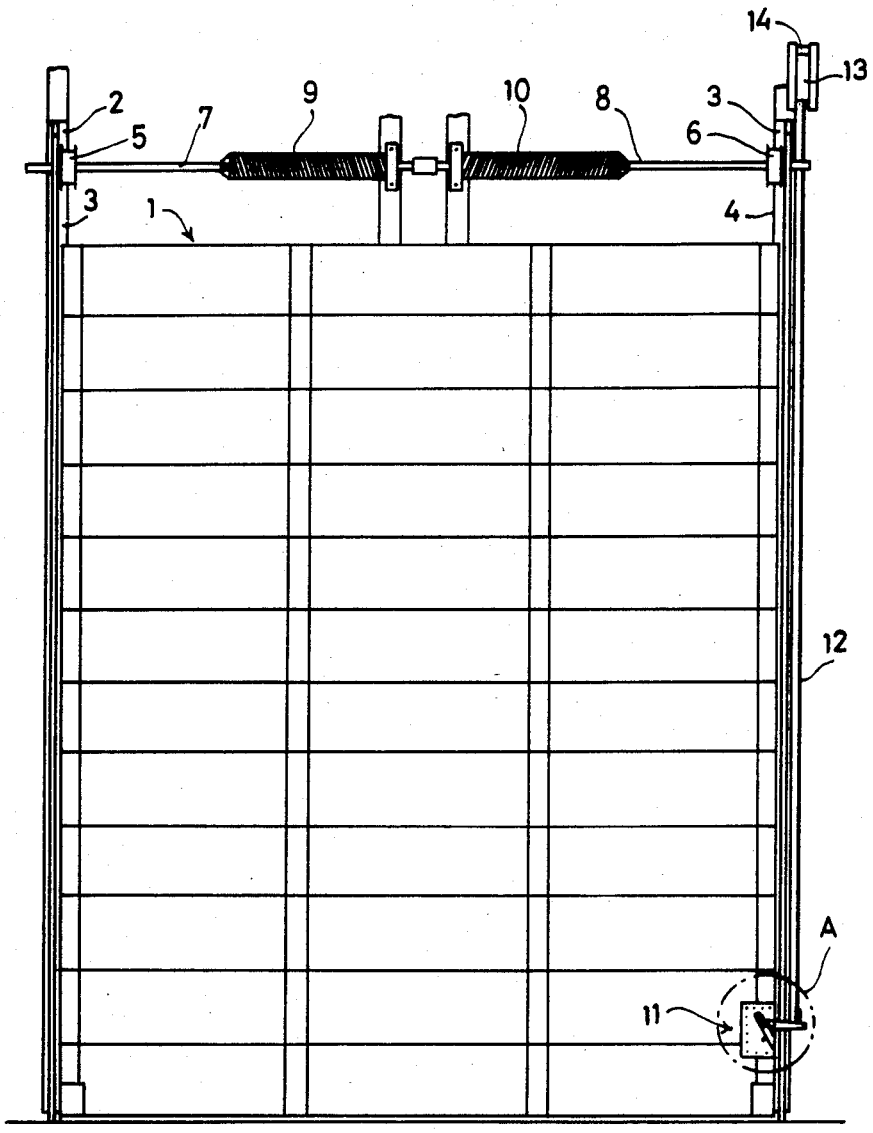
FIG. 1 shows a diagrammatic view of an overhead door, which is provided with a safety device according to the invention.
Figure 3:
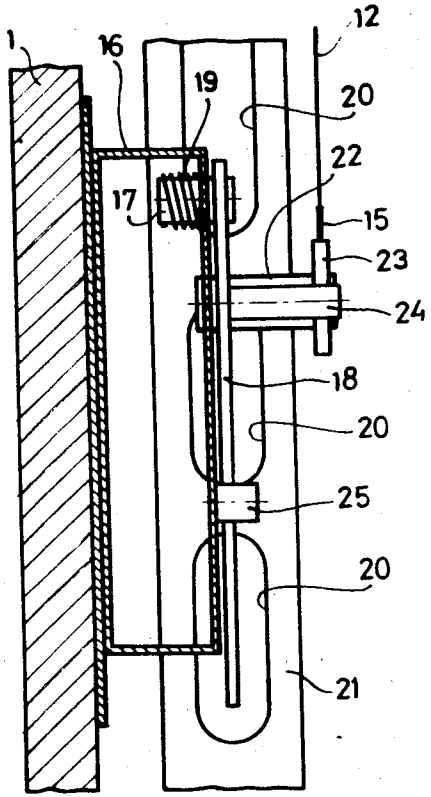
FIG. 3 shows a view along arrows III—III in FIG. 2.

FIG. 1 shows an overhead door 1 of known type, which is fastened, so as to be movable in the vertical direction, between two guides 2 and 3. The door is suspended from operating cables 3, 4 guided over reels 5, 6 respectively which are mounted on a shaft 7, 8 which in turn is connected to a torsion spring 9, 10 respectively. With the aid of the abovementioned suspension construction the door can easily be moved into the vertical direction, as a result of which the torsion springs 9, 10 act as compensating elements for the weight of the door.

If for any reason the operating cables 3, 4 or the torsion springs break, the door, when it is in its raised position, will come down at a speed beyond certain limits, which can cause danger to people or objects under the door or irreparable damage to the door itself.

In order to avoid these risks the door is provided with a safety device comprising fastening means 11 for blocking the door, which means is operated via an auxiliary cable 12, which is connected on the one hand to the door 1 and on the other hand to a reel 13, which reel is provided with a speed-limiting means 14.

The reel 13 with the speed-limiting means 14 is of a known type and is described, for example, in the abovementioned French Pat. No. 384,422, and will therefore not be described in detail here. It is sufficient to state that the speed-limiting means 14 blocks the reel 13 when the latter rotates at a greater speed. The auxiliary cable 12, which is provided with a breaking element 15, will likewise block and break as a result of the speed and weight of the door. The breaking of the auxiliary cable releases the fastening means for blocking the door, in a manner which will be described below.

Figure 2:
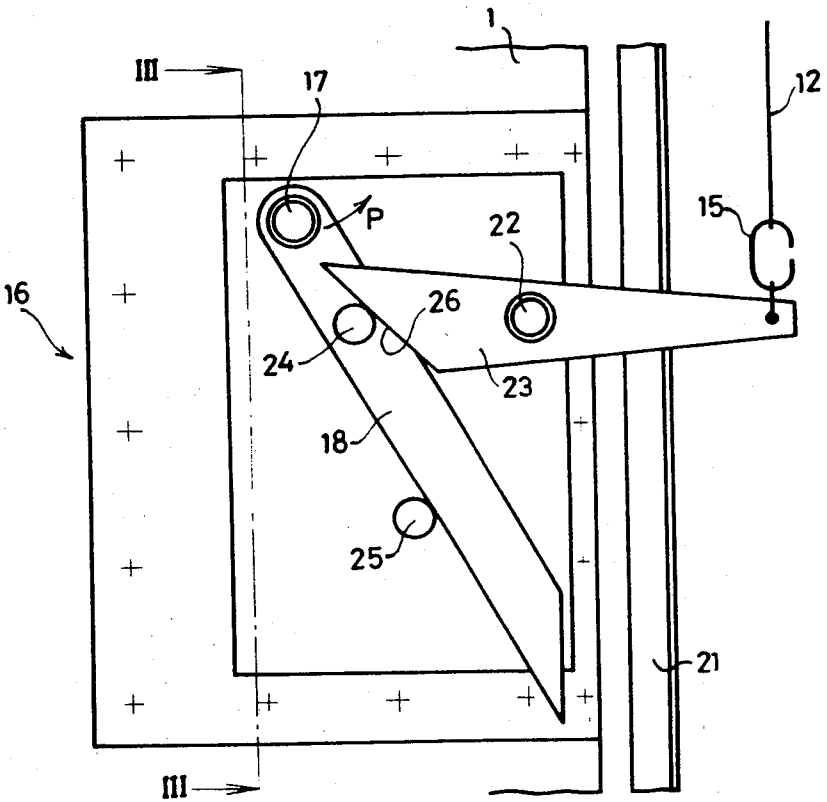
FIG. 2 shows on an enlarged scale detail A of the safety device in FIG. 1.

As is shown more clearly in FIG. 2, the fastening means consists of a housing 16 which is fixedly connected to the door, a shaft 17 being rotatably mounted in this housing. On its end projecting from the housing the shaft 17 carries a bar 18 fixedly connected to the end. A spring 19 is attached around the shaft 17 in the housing, which spring presses the shaft with the bar 18 in the direction of arrow P, that is to say into a position in which the free outer end of the bar 18 projects out of the side edges of the door and can engage into openings 20 of a frame 21 mounted along the side edge of the door.

A lever 23 is rotatably mounted on the outer end of a pin 22 which is attached to the exterior of the housing 16, while one outer end of the lever 23 is connected to the auxiliary cable 12 and the outer end of the lever presses against a cam 24 attached to the bar 18. As a result of the tension in the auxiliary cable 12 the lever 23 presses the bar 18 against the action of the spring 19 into a stop 25 which is attached to the housing 16. The outer end of the lever 23 cooperating with the cam 24 has a sloping edge 26, so that the cam 24 rotates the lever in a clockwise direction when the auxiliary cable breaks.

During normal use of the door the auxiliary cable is always under tension by springs means not shown in the drawings. These spring means have to withstand the pressure to which the lever is subjected, via the cam 24, by the spring 19, in order to hold the fastening means in a non-blocking position. This has the result that when the auxiliary cable becomes tensionless for any reason the safety device automatically becomes operative.

If the rate of descent of the door is too great as a result of one defect or another the reel 13 will, as said before, be blocked and the auxiliary cable 12 will break by means of the breaking element 15. As a result of the pressure to which the lever 23 is subjected via the cam 24 by the spring 19, the lever will rotate in a clockwise direction, and the bar 18 rotates at the same time about the shaft 17 in the direction of arrow P. The bar 18 will engage with its free outer end into one of the openings 20 in the frame 21, and is subsequently held back by the pin 22 which carries the lever 23. The door is blocked in this position.

Although the safety device is described here for an overhead door it will be clear that the safety device can be used with any vertically movable member, such as lifts, blinds and the like.

Moreover, various modifications can be employed within the scope of the invention, for example with respect to the constructional embodiment of the fastening means. Thus, after breaking of the element 15, the lever 23 can for example also rotate by means of a weight connected to the latter. The bar 18 can consist of a longitudinally displaceable pin, which slides to the outside when the element 15 breaks under spring pressure. A displaceable pin of this type has the advantage that it engages more quickly into the openings 20 in the frame 21.

What is claimed is:

1. Safety device, in particular for an overhead door, comprising fastening means for blocking the door, which means is operated by an auxiliary cable under tension, which is connected on the one hand to the door and on the other hand to a reel provided with a speed-limiting means, the latter blocking the reel and hence the auxiliary cable when the door exceeds a predetermined rate of descent and the fastening means becomes operative, the auxiliary cable being provided with a breaking element which breaks when the reel is blocked, while the fastening means is under pressure and becomes operative when the tension in the auxiliary cable is removed, a lever-shaped locking lever is fastened rotatably to the door, the lever being connected on the one hand to the auxiliary cable and on the other hand acting upon the fastening means, and the locking lever being capable of holding the fastening means under spring pressure in a non-operative position as a result of the tension in the auxiliary cable, the fastening means is defined by a bar, which is movably connected to the door so as to engage with one of its outer ends into one of openings in a post attached beside the door, the bar being under pressure from a spring which seeks to press the bar into engagement with the post and being provided with a projecting cam which cooperates with the locking lever.

2. Safety device according to claim 1, wherein the locking lever is fastened at the outer end of a projecting pin, the latter also forming a stop for the bar, when the bar is in engagement with the post.

3. Safety device according to claim 1, wherein the outer end of the locking lever cooperating with the cam on the bar is bevelled, so that the cam brings about rotation of the lever which is withstood by the auxiliary cable.

4. Safety device according to claim 1, wherein said bar is rotatably connected to the door near one outer end and can engage with its other free outer end into one of openings in a post attached beside the door.

* * * * *